United States Patent [19]

McInerney

[11] 4,150,626

[45] Apr. 24, 1979

[54] RAILWAY TRUCK SPAN BOLSTER

[75] Inventor: Frank T. McInerney, Lakewood, Colo.

[73] Assignee: MIWS-Worthington Limited, Montreal, Canada

[21] Appl. No.: 744,324

[22] Filed: Nov. 23, 1976

Related U.S. Application Data

[63] Continuation-in-part of Ser. No. 543,789, Jan. 24, 1975, abandoned.

[51] Int. Cl.[2] ..... B61F 3/10; B61F 5/20; B61F 5/24; B61F 5/52

[52] U.S. Cl. ..... 105/199 F; 105/182 R; 105/183; 105/202; 105/226

[58] Field of Search ..... 105/136, 183, 192, 195, 105/197 A, 199 R, 211, 212, 213, 226, 182 R, 199 F, 202, 227

[56] References Cited

U.S. PATENT DOCUMENTS

| | | | |
|---|---|---|---|
| 65,788 | 6/1867 | Allen | 105/183 |
| 805,105 | 11/1905 | Timmis | 105/199 R |
| 2,089,110 | 8/1937 | Bugatti | 105/183 |
| 2,782,026 | 2/1957 | Hirst | 105/197 A X |
| 2,954,747 | 10/1960 | Hirst et al. | 105/199 R X |
| 3,342,140 | 9/1967 | Lich | 105/226 X |
| 3,348,500 | 10/1967 | Akitt | 105/183 |
| 3,547,046 | 12/1970 | Lich | 105/136 X |
| 3,563,185 | 2/1971 | Wilmot et al. | 105/136 X |
| 3,618,533 | 11/1971 | Hirst | 105/195 |
| 3,693,553 | 9/1972 | Lich | 105/136 |
| 3,712,245 | 1/1973 | Lich | 105/199 A X |
| 3,713,397 | 1/1973 | Parker et al. | 105/136 |

FOREIGN PATENT DOCUMENTS

| | | | |
|---|---|---|---|
| 526671 | 6/1956 | Canada | 105/183 |

*Primary Examiner*—Albert J. Makay
*Assistant Examiner*—Howard Beltran
*Attorney, Agent, or Firm*—Charles E. Brown

[57] ABSTRACT

A span bolster arrangement for interconnecting a pair of railway trucks and mounting a railway vehicle chassis, the span bolster arrangement including a span bolster structure having side members interconnected by lateral members and being mounted on and connected to a pair of railway trucks located beneath opposite ends thereof. The span bolster structure carries a plurality of elastic chassis support pads including primary load bearing pads and secondary stabilizing pads, which pads engage the underside of a vehicle chassis. The arrangement of the pads is such that axes of the pads intersect at a virtual point on a longitudinal central plane of the span bolster structure and approximately midway between the pair of trucks and at a height substantially corresponding to rail level.

16 Claims, 20 Drawing Figures

RAILWAY TRUCK SPAN BOLSTER

This application is a continuation-in-part of application Ser. No. 543,789, filed Jan. 24, 1975, now abandoned.

BACKGROUND OF THE INVENTION

1. Field of the Invention

The present invention relates to an improved span bolster arrangement for connecting pairs of railway trucks to a vehicle chassis in such a manner as to minimize weight transfer from one truck to the other when the axles of the trucks are exerting tractive or braking effort.

2. Description of the Prior Art

When it is desired to increase the number of powered axles in a locomotive truck to more than three, two possibilities are immediately evident. One solution is to provide a longer rigid wheel base, with four or more axles. However, a longer rigid wheel base necessarily develops higher flange forces when negotiating curves, and can also be subject to axle load changes when negotiating vertical curves, depending upon the suspension arrangement. The other solution is to utilize sub-bogie or truck arrangements, the sub-bogie or truck arrangements being connected by a structure commonly referred to as a span bolster. In particular, a span bolster arrangement is a sub-frame structure sitting on top of two trucks with the effective weight of one end of the locomotive frame or railway car being supported by the span bolster. In known span bolster arrangements, the effective weight of one end of the locomotive frame or railway car is applied to the span bolster structure at a location approximately mid-way between the two trucks. This arrangement is commonly used with a locomotive frame supported by four 2-axle trucks, such that the locomotive railway car has eight axles altogether. Other less common truck arrangements for supporting locomotives or railway cars include the use of four 3-axle trucks with a span bolster interconnecting the two pairs of 3-axle trucks. In this arrangement, the locomotive or railway car is supported by twelve axles altogether. Additionally, a ten-axle arrangement can be utilized, this arrangement having two 2-axle trucks interconnected by a span bolster and two 3-axle trucks interconnected by a span bolster. Other combinations of truck arrangements can also be provided, including arrangements where a span bolster interconnects a 2-axle truck and a 3-axle truck.

The use of a span bolster arrangement provides a very flexible support system for a locomotive or railway car insofar as the ability of the locomotive or railway car to negotiate lateral and vertical curves. Further, the end of the span bolster structure adjacent the end of the locomotive or railway car can be adapted to support a coupler arrangement, the coupler arrangement being designed to interconnect one locomotive or railway car to another. However, for the purposes of the present invention, the couplers must be positioned directly on the locomotive frame in order to realize the zero weight transfer potential from one truck to another.

It is known in the prior art to provide a truck assembly adapted to maintain substantially equal loading on the axles of a 2-axle truck. In this regard, U.S. Pat. No. 3,713,397, issued Jan. 30th, 1973 to Parker et al, discloses such an arrangement whereby a 2-axle truck is resiliently suspended on a central post, the resilient suspension permitting rotation of the truck about a horizontal axis located approximately at ground level and in line with the vertical axis of rotation of the truck about the post. Such an arrangement facilitates balancing of loading on the drive wheels of the truck during acceleration or deceleration, thereby improving the overall traction of the locomotive. Further, U.S. Pat. No. 2,954,747 to Hirst et al discloses an arrangement for locating the traction point of a bogie or truck having an uneven number of pairs of wheels beneath the central axle of the truck. By utilizing such an arrangement, the bolster is eliminated such that the weight and complexity of the suspension is correspondingly reduced.

Other low weight transfer trucks with which the present invention might be utilized have been described in U.S. Pat. Nos. 3,563,185 (Gen. Steel, 2-arm arrangement) 3,547,046 (Gen. Steel 4-arm arrangement). In addition to U.S. Pat. No. 2,954,747, a further 3-axle truck low weight transfer arrangement is described in U.S. Pat. No. 3,693,553 (Gen. Steel).

Each of the prior art patents referred to recognize the advantage of utilizing zero weight transfer trucks by locating the traction point, that is, the point of application of the resultant longitudinal force acting between the truck and the body of the railway vehicle, at or adjacent to rail level. Since any structure at rail level would foul trackwork, the above solutions for establishing the traction point adjacent rail level do so by establishing a virtual, or non-real, traction point at or adjacent to rail level. However, in known arrangements utilizing span bolsters mounted on trucks with the weight of one end of the locomotive chassis mounted on the span bolster being applied to the span bolster at a location midway between the trucks, weight transfer occurs from one truck to the other when axles of the trucks are exerting tractive or braking effort. The transfer of weight from one truck to another results in the wheels of the truck from which the load is being transferred losing their adhesion with the rails, such that the traction motors connected to the axles of the truck do not effectively transfer their power to the rails.

Apart from providing a span bolster construction which minimizes weight transfer from one truck to another, there are specific design constraints with respect to the construction of span bolsters. These design constraints include the following:

(a) The bolster must receive the effective weight of the portion of the chassis supported thereby at a location approximately midway along the length of the span bolster plate in order to permit distribution of the load to the two trucks.

(b) The locomotive chassis must suitably engage the span bolster, and the entire assembly (trucks, span bolster, and chassis) must pass through the clearance diagram of the user railroad; and (c) Other design considerations with respect to ease of movement, dynamic stability, good maintainability, etc. must be met, as for any other running gear arrangement.

With respect to the design criteria noted above, the major problem of the present span bolsters is to meet the constraint noted under heading (b) above, that is, passing through the given clearance diagram. In particular, where the load of one end of a locomotive chassis or railway car is applied at a location midway between the two trucks, that is, half way along the length of the span bolster, substantial bending moments are developed in the longitudinal members of the span bolster, necessitating the use of a large span bolster structure, such that the resulting locomotive or railway car is usually quite tall and, in certain instances, too tall to meet the clearance diagram requirements of the user railroad.

In addition to minimizing the weight transfer from one truck to another, the present invention proposes to provide a span bolster structure compatible with 2-axle and 3-axle trucks, which minimizes bending moments in the longitudinal members of the span bolster, thereby permitting the use of a smaller span bolster structure. Minimization of the bending moments in the longitudinal members of the span bolster and minimizing load transfer from one truck to another is achieved, in part, by providing a direct load transfer from the chassis, through the span bolster, to the trucks. Thus, to avoid transferring weight from one truck to the other, the span bolster arrangement must have points of attachment to the chassis of the locomotive or railway car that are collinear with the points of attachment of the trucks to the span bolster. To achieve the most effective load path from chassis to trucks, the portion of the weight of the locomotive chassis or railway car supported by each span bolster should be applied equally and directly to each of the trucks or, in effect, the portion of the chassis supported by the span bolster should sit on the two, three or more trucks of the arrangement in the manner of a beam having multiple equal-reaction supports. Although the span bolster is situated between the chassis and the trucks, the load path from the chassis to the trucks is still considered as being direct, since the locations where the portion of the chassis load is supported by the span bolster are substantially collinear or co-planar with locations where the loads are applied by the span bolster, with the chassis mounted thereon, to the trucks, when viewed from the side of the locomotive. In this way, the loads applied to the span bolster at each location along the length thereof are balanced in a vertical direction, whereby bending moments in the longitudinal members of the span bolster are minimized and with proper design care, will be substantially zero.

SUMMARY OF THE INVENTION

According to a broad aspect thereof, the present invention provides a span bolster arrangement for interconnecting a pair of railway trucks, the span bolster arrangement including a span bolster structure having side members interconnected by lateral members, the span bolster structure being mounted on a pair of railway trucks located beneath opposite ends of the span bolster structure. A plurality of elastic pads are mounted on the span bolster structure, the plurality of elastic pads comprising primary load bearing pads and secondary stabilizing pads. Free ends of the primary and secondary pads are adapted to be connected to a lower surface of one end of a vehicle chassis so as to support the one end of the vehicle chassis in position above the span bolster structure. The primary load bearing pads are positioned and oriented on the span bolster structure so that their compression axes extend downwardly and inwardly and all intersect at a virtual point on a longitudinal central plane of said vehicle chassis and approximately midway between said pair of trucks and at a height substantially equal to rail level. The primary pads are also positioned longitudinally so that vertical components of compression therein due to a portion of the weight of the vehicle chassis supported thereby are substantially in transverse planes defined by locations where the span bolster structure is connected to the railway trucks. The transverse planes extend at right angles to the central longitudinal plane, the locations of the primary pads being such that bending moments in the side members are substantially eliminated. Two secondary stabilizing pads are positioned on the side members of the span bolster structure and oriented so that the compression axes of the secondary pads extend upwardly and inwardly so as to intersect at a point in the longitudinal central plane of said vehicle chassis and substantially directly above said point of intersection of the compression axes of the primary pads and at a height above the height of the centre of gravity of the vehicle chassis so as to stabilize the vehicle chassis vertically and centrally against the portion of the weight of the vehicle chassis supported by the span bolster structure, thereby preventing tipping of the vehicle chassis off of the span bolster structure.

BRIEF DESCRIPTION OF THE DRAWINGS

The preferred embodiments of the present invention will now be described with reference to the examples illustrated by the accompanying drawings, in which.

DESCRIPTION OF THE PREFERRED EMBODIMENTS

Figure 1:
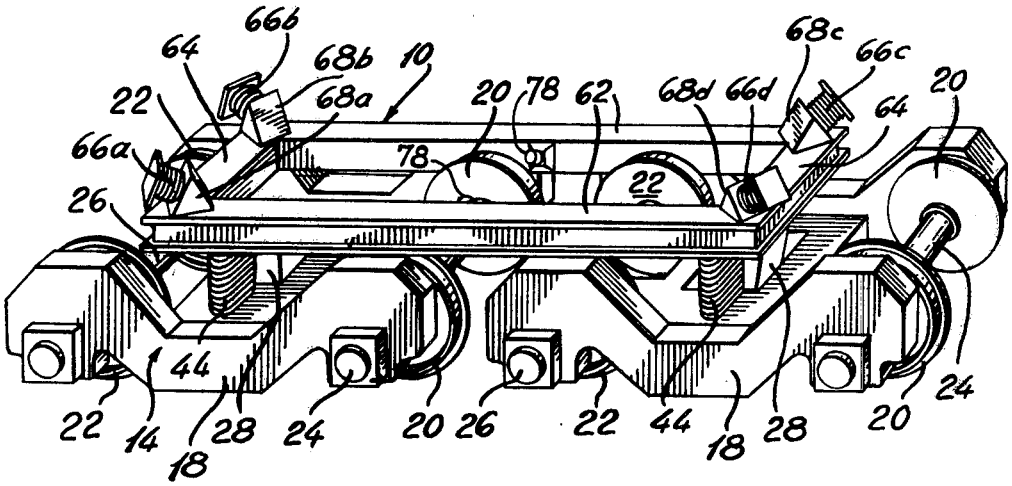
FIG. 1 is a perspective view of two 2-axle trucks interconnected by a span bolster structure.
Figure 2:
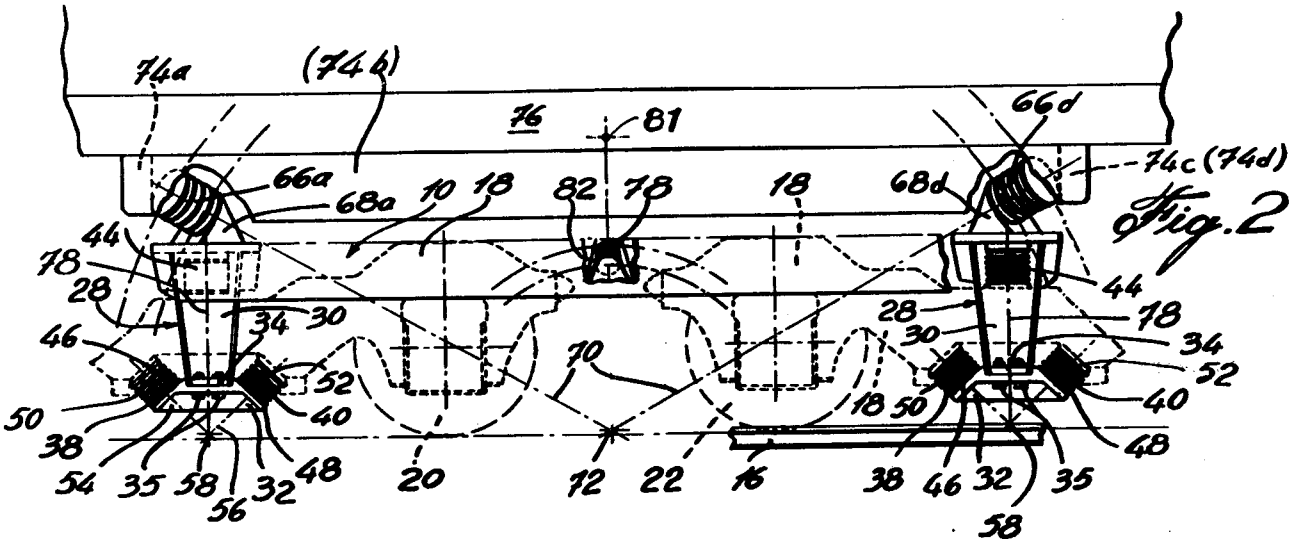
FIG. 2 is a side view, partly broken away, showing the span bolster structure of the present invention associated with two 2-axle trucks.

Throughout the drawings, similar component parts of the span bolster arrangement are designated by the same reference numerals. In FIGS. 1 to 4, a span bolster structure is indicated generally by reference numeral 10, the span bolster structure 10 interconnecting two 2-axle trucks 12 and 14, the trucks being indicated in phantom in FIGS. 2 and 3. In FIG. 2, the phantom lines indicate only one end of each of the two adjacent 2-axle trucks, the trucks being positioned on a rail 16. The 2-axle trucks illustrated in FIGS. 1 and 2 are of a construction as described in detail in U.S. Pat. No. 3,713,397, to Parker et al. Each of the trucks 12 and 14 include a respective truck frame 18 mounted on pairs of wheels 20 and 22, the wheels being mounted on respective axles 24 and 26 at opposite ends of each truck.

Figure 5:
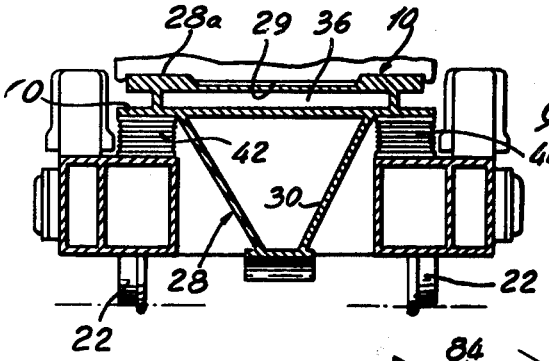
FIG. 5 is a vertical cross-section illustrating the detailed construction of the centre post assembly.

As best seen in FIGS. 2 and 5, each truck includes a centre post assembly or structure 28, the upper surface 28*a* of which supports the adjacent lower surface 29 of the adjacent portion of the span bolster structure 10. The centre post assembly or structure 28 includes a centre post 30, a lower bearing section 32 adjacent the free end 34 of the centre post 30, and an upper bearing section 36 positioned adjacent the mounting end of the post assembly.

Each truck frame 18 and its respective centre post structure 28 are interconnected by suitable bearing means such as resilient members illustrated in FIG. 1 as being resilient pads. There are two pairs of pads formed by individual resilient pad means 38, 40 and 42, 44 respectively.

As best seen in FIG. 2, each lower bearing structure 32 in the illustrated arrangement is secured to the bottom end of each centre post 30 by means of bolts 35, or other suitable means, and is provided with a pair of bearing surfaces 46 and 48 on opposite sides of the centre post 30. Further, each truck frame 18 is provided with a pair of bearing surfaces 50 and 52 situated opposite respective bearing surfaces 46 and 48 of the centre post structure 28. The slope of the surfaces 46, 48, 50 and 52 is approximately 45° and the resilient means 38 and 40 have their longitudinal axes 54 and 56 substantially perpendicular to the sloped surfaces, such that the longitudinal axes intersect at an angle of approximately 90°. The point of intersection 58 of the longitudinal axes 54 and 56 is adjacent to the level of rails 16. The purpose of locating the point 58 adjacent to rail level is explained in detail in U.S. Pat. No. 3,713,379, and is incorporated herein by reference.

In FIG. 5, the resilient pads 42 and 44 are arranged to bear on an upper surface of each truck 18, and a bearing surface 60 of the upper bearing section 36 of the centre post structure 28 is secured to the pads 42 and 44 by means of bolts, or other suitable fasteners. The resilient pads 38, 40, 42 and 44 are compressed when the vehicle chassis is in position, the pads 42 and 44 being compressed by the portion of the weight of the vehicle chassis supported thereby and additionally by precompression in pads 38 and 40. Precompression in pads 38 and 40 is achieved when the lower bearing structure 32 is drawn up to the centre post 30 by means of bolts 35.

Figure 3:
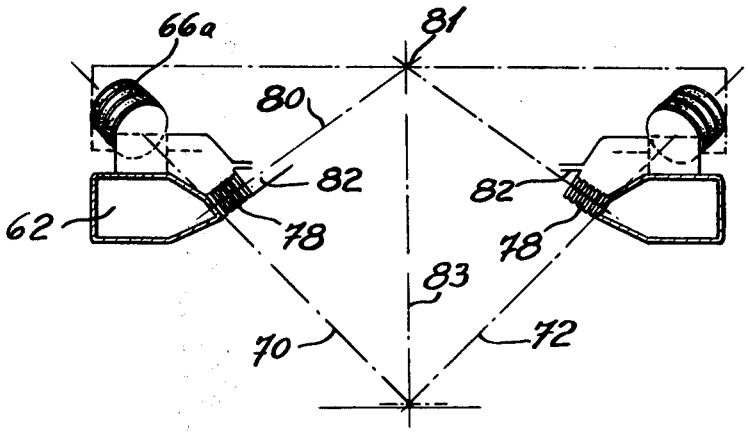
FIG. 3 is a vertical section taken along the line III—III of FIG. 4, illustrating the respective positions of the primary and secondary resilient pads.

The span bolster structure 10 is rectangular in plan view and comprises longitudinal side members of tubular rectangular steel construction, as best seen in FIG. 3. Opposite ends of the longitudinal side members 62 are rigidly interconnected by lateral end members 64, the lower surface 29 of the lateral end members being securely connected to the upper surface 28*a* of the upper bearing section 36 of centre post structure 28. The lateral members 64 are secured to the upper bearing sections 36 by bolts, or other suitable fasteners, such that the span bolster structure 10 rigidly interconnects the pair of centre posts 30 of the two 2-axle trucks 12 and 14. The weight of the span bolster structure 10, together with the weight of the portion of the vehicle chassis supported thereby, compresses the pads 42 and 44.

The upper surface of the span bolster structure 10 has four primary resilient pads 66*a*, 66*b*, 66*c*, and 66*d* mounted thereon adjacent diagonally opposite corners of the span bolster structure. The method of securing the pads to the span bolster and to the vehicle chassis is illustrated diagrammatically in FIG. 12, and the accompanying description below. However, in FIG. 4, the primary resilient pads 66*a* to 66*d* are connected by means of bolts or similar fasteners to respective wedge-shaped sections 68*a*, 68*b*, 68*c*, and 68*d* located at the corners of the span bolster structure. The angle of the wedge-shaped sections are identical and are such that the longitudinal axes 70 of the primary resilient pads, when extended downwardly, meet at a common point of intersection 72. The upper ends of each of the resilient primary pads are connected by suitable fasteners, such as bolts, to corresponding wedge members 74*a* to 74*d*, the latter wedge-shaped members being rigidly secured to a lower surface of a vehicle chassis, indicated generally in FIG. 1 by reference numeral 76. The vehicle chassis 76 could comprise a locomotive or railway car. However, the present invention could likewise apply to tramway vehicles as well, and still be within the scope of the present invention.

While one end of the chassis 76 is mounted on the span bolster structure 10, an opposite end of the chassis 76 can be mounted either on a similar span bolster structure or can be directly connected to a truck arrangement without the use of the span bolster structure, utilizing an arrangement similar to that described in U.S. Pat. No. 2,954,747 to Hirst et al. The primary pads 66*a* to 66*d* permit the span bolster structure to pitch fore-and-aft relative to the vehicle chassis 76. The pitching movement of the span bolster structure 10 relative to the chassis occurs about an imaginary horizontal transverse axis extending parallel to the level of the rails 16 and through the point of intersection 72. The point of intersection 72 is substantially at the same level as the points of intersection 58, referred to above.

The portion of the load of the vehicle chassis 76 supported by the primary resilient pads 66*a* to 66*d* includes vertical components of load in the primary pads, the vertical load components being located as close as practical to a transverse plane 77 extending through the centreline of the point of attachment of the trucks to the span bolster structure. The location of plane 77 is illustrated diagrammatically in FIG. 6, the latter being described in detail below.

Figure 4:
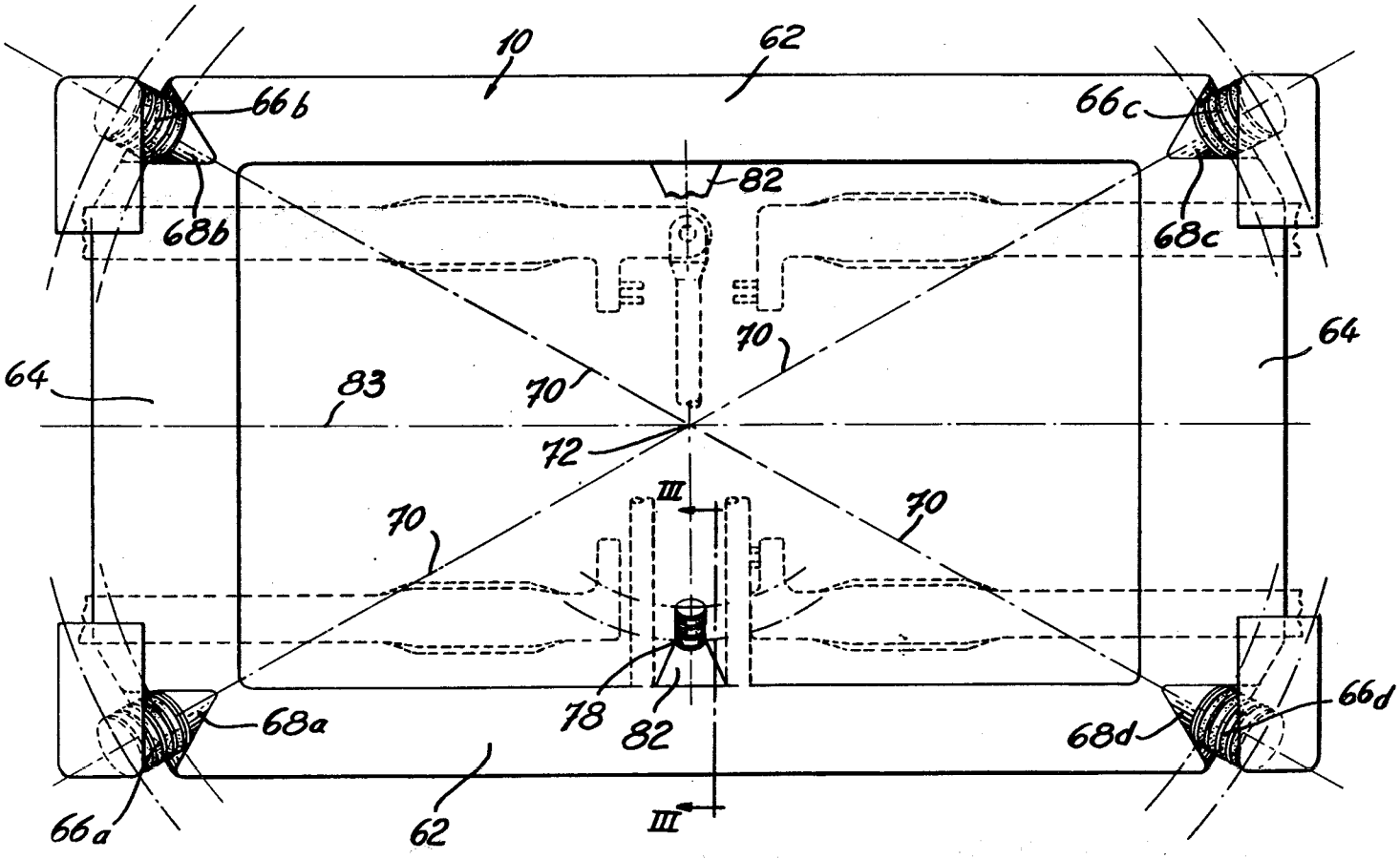
FIG. 4 is a top plan view of the span bolster structure according to FIG. 2.

The resilient primary pads define a vertical axis about which the bolster and associated trucks can rotate relative to the chassis to permit negotiation of curves. Since the point of intersection 72 of the 70 compression axes of the resilient primary pads 66*a* to 66*d* is below the centre of gravity of the vehicle chassis, the axes defining an unstable cone-like configuration, additional stabilizing elements are required to prevent the vehicle chassis from tipping off of the span bolster structure. The additional stabilizing elements comprise secondary stabilizing pads 78 which are mounted on inner surfaces of the longitudinal side members 62 of the span bolster structure 10. FIG. 3 of the drawings indicates the respective positions of the primary and secondary pads when viewed from the end of the span bolster structure, as well as the points of intersection of the respective compression axes thereof. The mounting of the secondary stabilizing pads 78 is such that their compression axes 80, when extended, intersect at a point of intersection 81. The secondary stabilizing pads 78 are secured to the inner surface of the side members 62 by suitable fasteners, such as bolts. The upper surface of each secondary stabilizing pad 78 is secured to a respective wedge member 82 having an engaging surface extending perpendicularly to the respective compression axes 80, the wedge members 82 being rigidly secured to the lower surface of the vehicle chassis 76. The secondary stabilizing pads are connected to the wedge members 82 by suitable fasteners such as bolts. In order to simplify the drawings, only one secondary stabilizing pad 78 is illustrated in FIG. 2 and 4.

The point of intersection 81 of the compression axes 80 is located in the central longitudinal plane 83 of the vehicle chassis. The point of intersection 81 is also located vertically above the point of intersection 72, and at a height adjacent to or above the height of the centre of gravity of the vehicle chassis in order to properly stabilize the vehicle chassis vertically and centrally against its own weight and against the lateral tractive effort component exerted by trailing equipment, not shown in the drawings.

Figure 12:
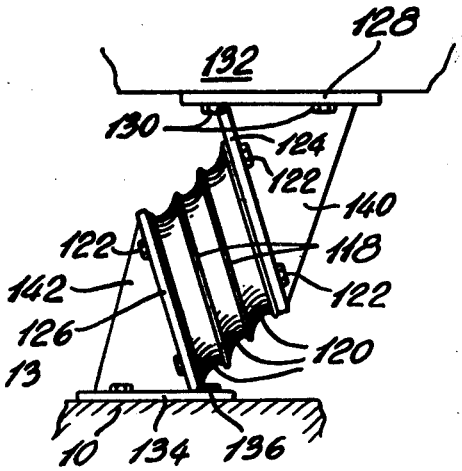
FIG. 12 is a side-elevation of one embodiment of a primary resilient pad interconnecting the span bolster structure and the lower surface of a chassis.
Figure 11A:
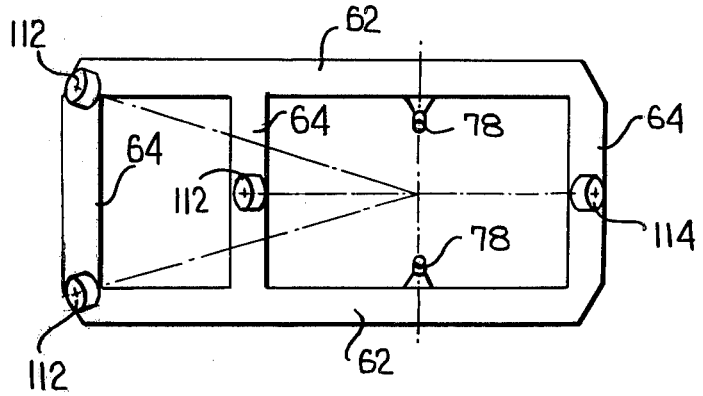
FIGS. 11*a*, 11*b*, 11*c* and 11*d* are schematic views similar to FIG. 11 of a like span bolster structure having different primary load bearing pad arrangements.
Figure 11B:
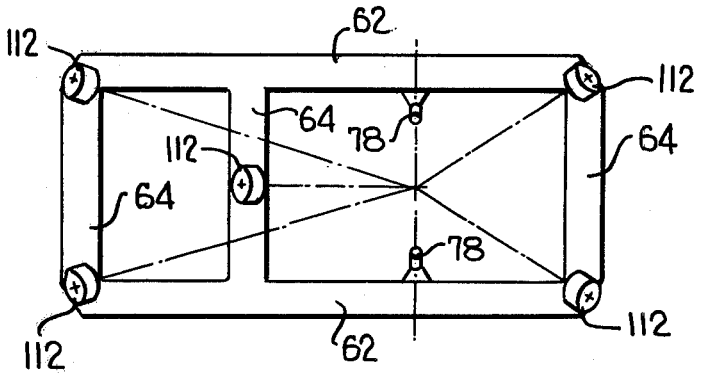
Figure 11C:
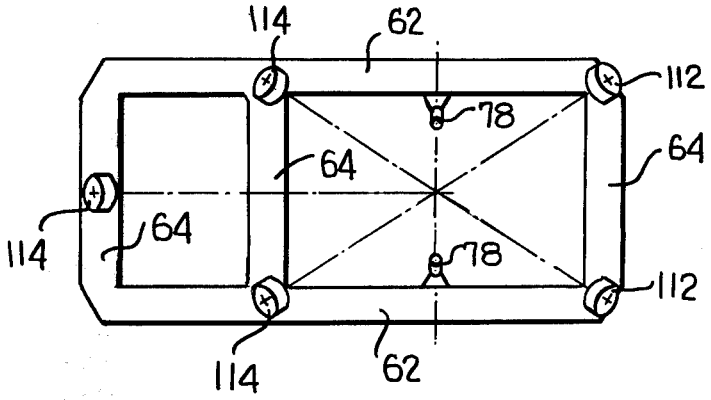
Figure 11D:
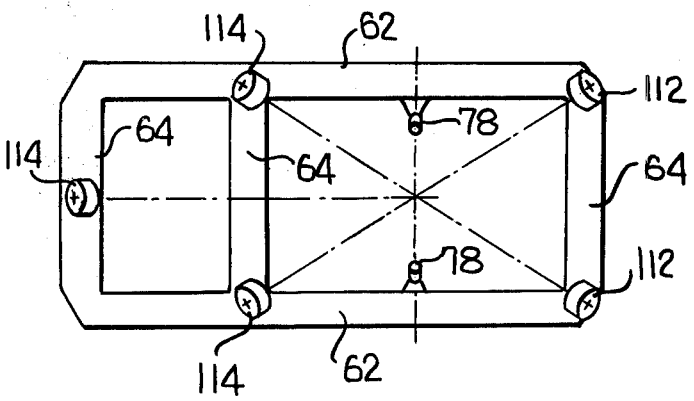

One suitable type of resilient pad which can be utilized for the primary and secondary resilient pads, as well as pads 38, 40, 42 and 44 comprises a laminate of rigid plates interposed by resilient pads, as illustrated in FIG. 12. The resilient pads have their greatest resistance to compression in a direction perpendicular to faces thereof, that is, in a direction parallel to the longitudinal axes of the resilient members. The characteristics of the rubber or resilient pads can be controlled to provide the required degree of resistance in their longitudinal directions, as well as in the directions extending transversely to the longitudinal axes of the pads. By correlating the dimensions of the pads together with their compositions and compression when installed, one can obtain the desired degree of resistance to movement in all of the directions in which the pads are likely to move.

Figure 6:
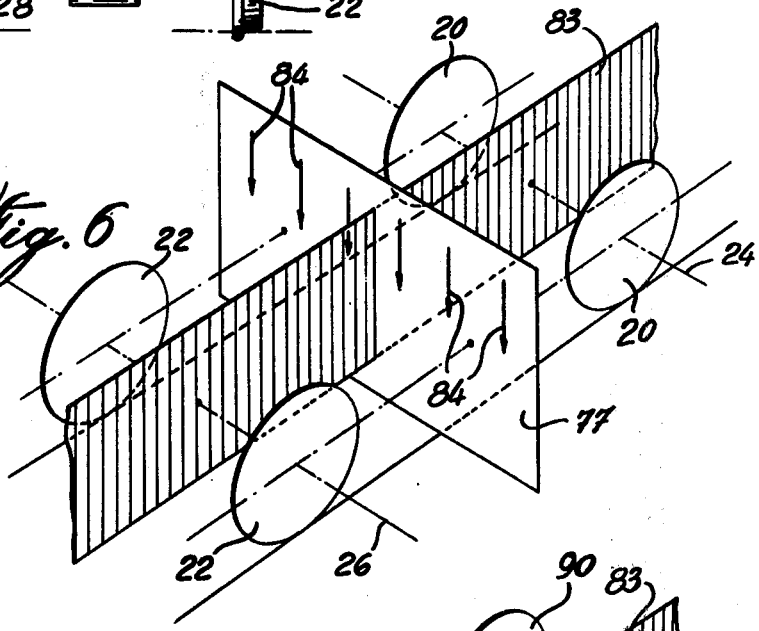
FIG. 6 is a perspective schematic view showing a load application plane relative to a 2-axle truck.

Referring now to FIG. 6, there is illustrated schematically the resultant load application plane of the span bolster 10 relative to a 2-axle truck wherein substantially all the weight load carried by the truck is applied at only one location longitudinally of the truck approximately midway between the axles 24 and 26 of the 2-axle truck. The weight load is defined by a transverse plane 77 extending vertically and at right angles to the central longitudinal plane 83 of the vehicle. In the transverse plane 77, there may be one central location, or a plurality of laterally spaced-apart locations, as indicated by arrows 84, where the weight load is applied to the truck.

Figure 8:
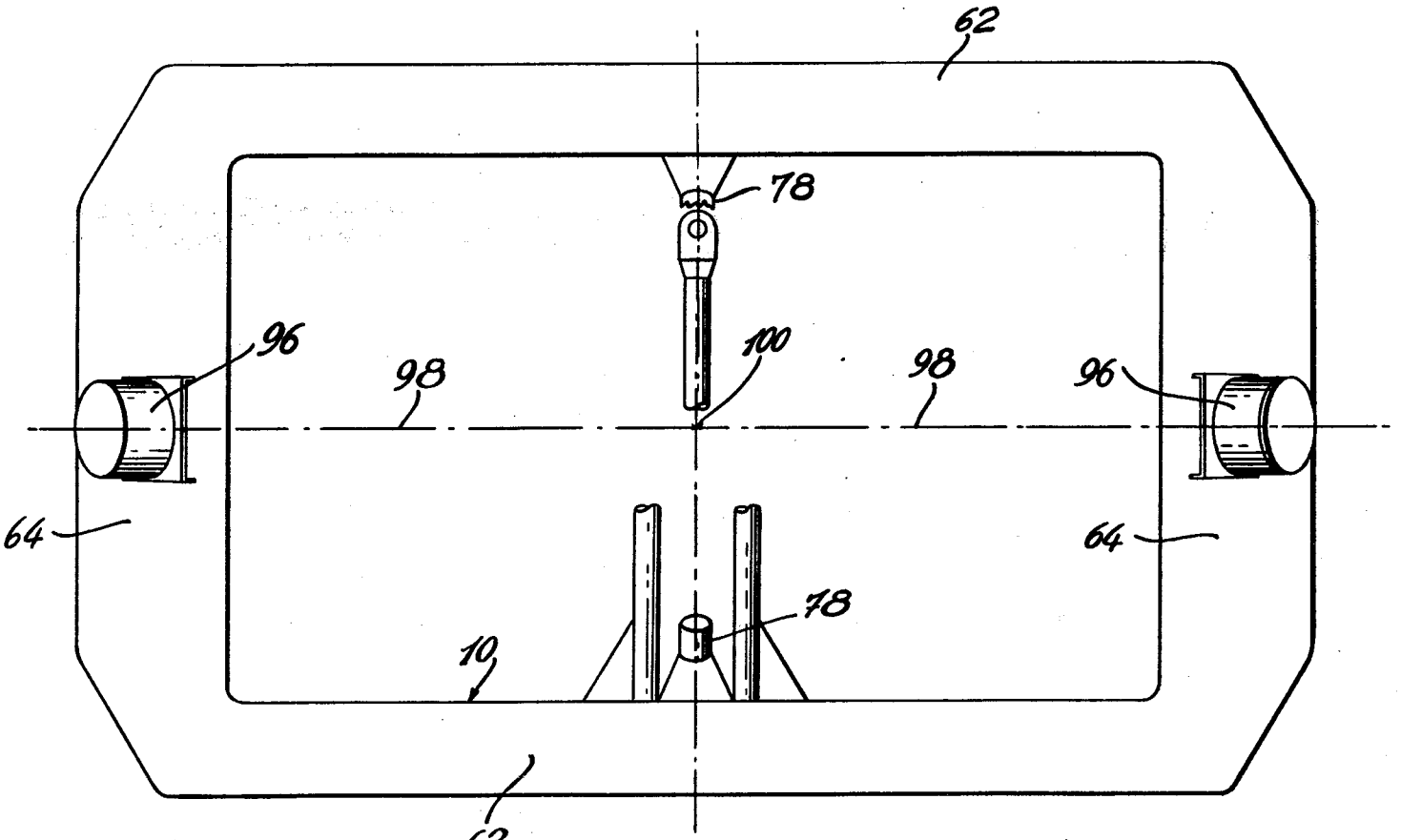
FIG. 8 is a top plan view similar to FIG. 4, illustrating a further embodiment of the present invention.

When used with 3-axle trucks, such as the one described in U.S. Pat. No. 2,954,747, the design approach would be similar to that used for the 2-axle trucks. That is, the load bearing pads of the span bolster would ideally be positioned directly above the load-bearing pads of each truck, so that no bending moments are produced in the span bolster. Design consideration for the vehicle chassis, traction motor air delivery and cabling, or service accessibility might make some compromise necessary on pad locations, such as combining either or both lateral pairs of pads of one end of the bolster on the centreline of the vehicle, or combining the side pairs to one pad per side per end, as seen in FIG. 8, approximately midway between the side pair of pads on the truck. It is recognized that such locations would then produce bending moments in either the transverse members or portions of the side members, but such moments would still be much smaller than the bending moment produced in conventional span bolster arrangements wherein the entire chassis weight is applied at the middle of the truck-to-truck span.

Figure 13:
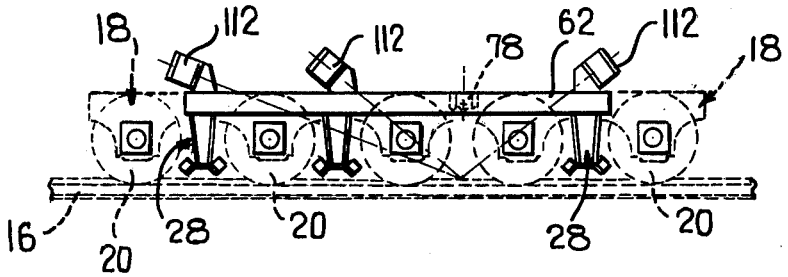
FIG. 13 is a schematic side elevational view similar to FIG. 10 and shows 3-axle - 2-axle combination.

It is also apparent that the same arrangement of pads does not have to be used above both trucks of a pair, if design considerations dictate otherwise, as seen in FIGS. 8 to 11, and the accompanying description below. Further, it is not even necessary for both trucks to be the same. For example, a 2-axle truck and a 3-axle truck could be used together, as seen in FIG. 13, and as described in detail below, with a suitable arrangement of pads for a 3-axle truck being provided above the 3-axle truck and an arrangement for a 2-axle truck being provided over the 2-axle truck. It is only necessary to locate the virtual centre of the bolster-to-chassis connection in the longitudinal direction so that the proper weight is carried on each truck (usually axle loads would be designed to be the same) and so that the longitudinal components of the pad compression forces are in balance.

Figure 7:
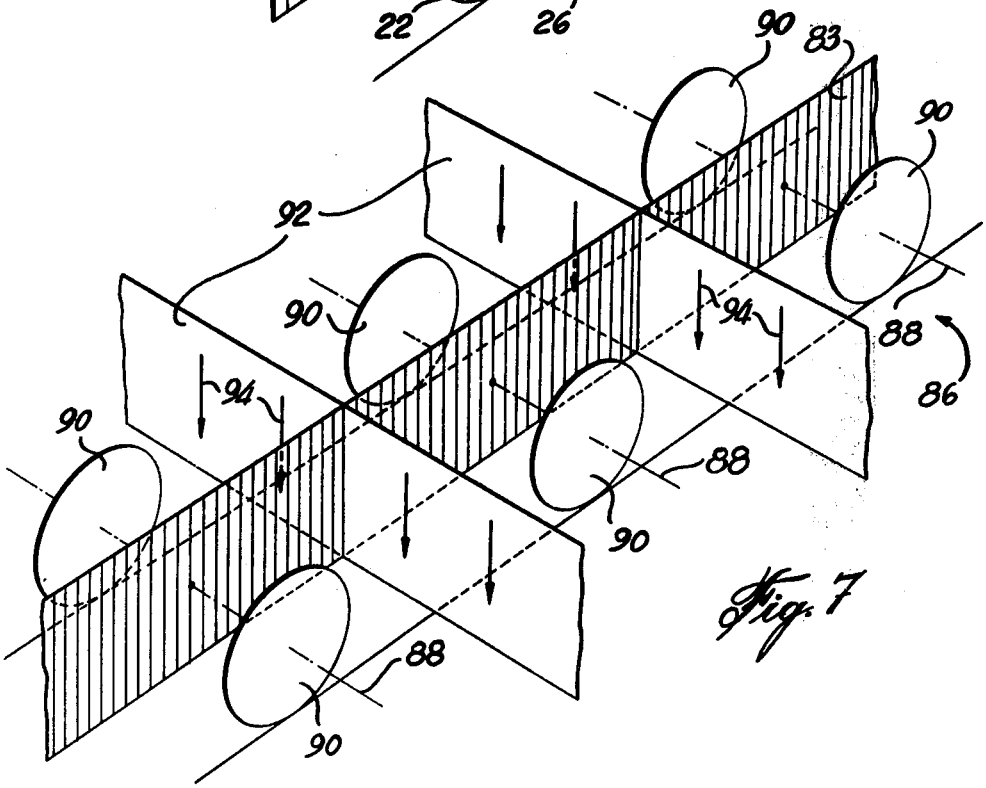
FIG. 7 is a perspective schematic view showing the load application planes relative to a 3-axle truck.

Referring now to FIG. 7, there is illustrated the load application planes of a span bolster structure intended to be used with two, 3-axle trucks, one of which is indicated schematically at 86 and comprising three axles 88, each extending through a pair of respective wheels 90. Substantially all of the weight load to be carried by each truck is applied at two longitudinally spaced-apart locations on the truck, which are usually, but not always, located between adjacent axles. Each location is represented by the transverse planes 92 which extend vertically and at right angles to the central longitudinal plane 83 of the vehicle. In each of the transverse planes 92, there may be one central or two laterally spaced-apart locations, or a plurality of locations, designated by the arrows 94, where the weight load is applied to the truck 86. Further, there may be additional locations where some stabilizing force is supplied by the truck to the vehicle (not shown), but where the force is sufficiently low to be of minor significance when compared to the force at the two longitudinal spaced-apart locations.

Figure 8A:
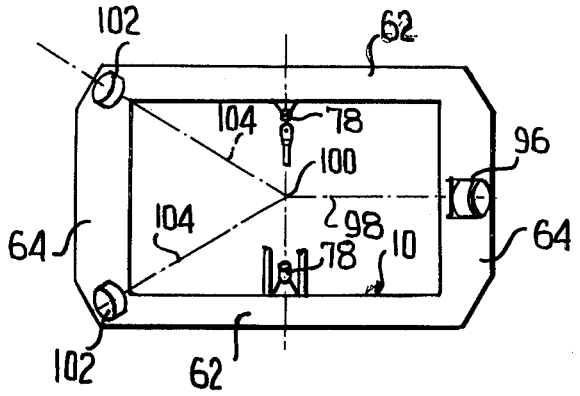
FIG. 8*a* is a schematic view similar to FIG. 8 of a like span bolster structure having a different primary load bearing pad arrangement.

FIG. 8 of the drawings illustrates a further embodiment of a span bolster 10 utilizing two primary pads 96, the compression axes 98 of which extend downwardly and intersect at a point 100. One of the primary resilient pads 96 could be replaced by two primary pads 102, as shown in FIG. 8*a*. In such an arrangement, the two primary pads 102 would be located at one end of the span bolster structure, while only one primary pad 96 would be located at the opposite end thereof. As a result, the primary pads need not be symmetrically positioned with respect to a transverse plane 77. In this latter arrangement, the compression axes 104 of the primary resilient pads 102 would intersect the compression axis 98 of the resilient pad 96 at the point 100.

Figure 10:
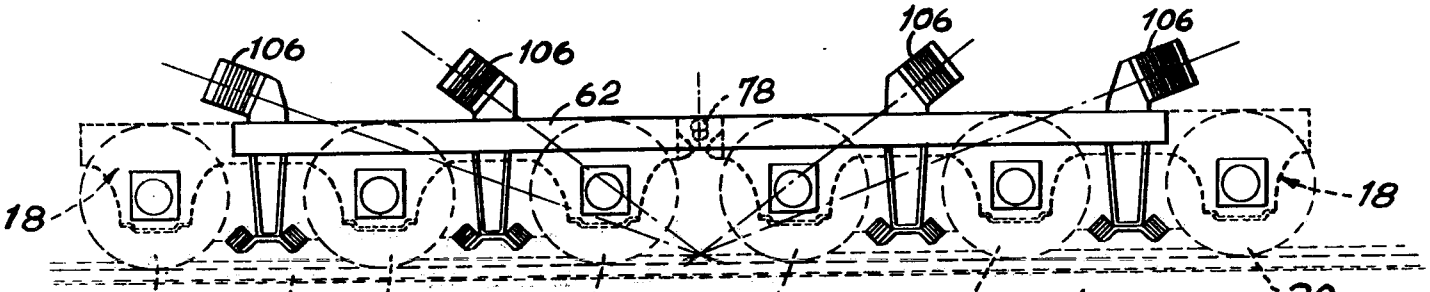
FIG. 10 appearing on the same page of drawings as FIG. 2, is a side view of an arrangement according to the present invention for interconnecting two 3-axle trucks.
Figure 9A:
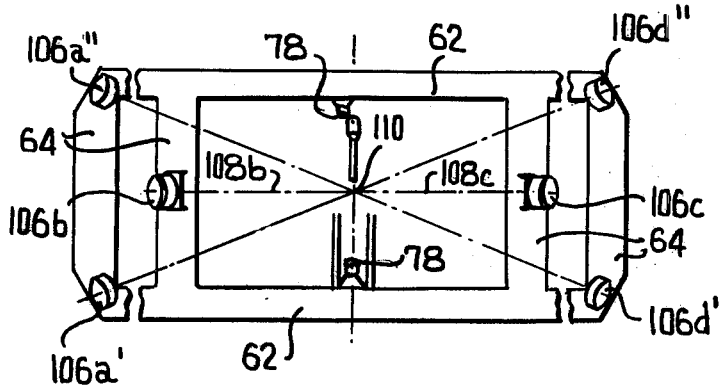
FIGS. 9*a* and 9*b* are schematic views similar to FIG. 9 of a like span bolster structure having different primary load bearing pad arrangements.
Figure 9B:
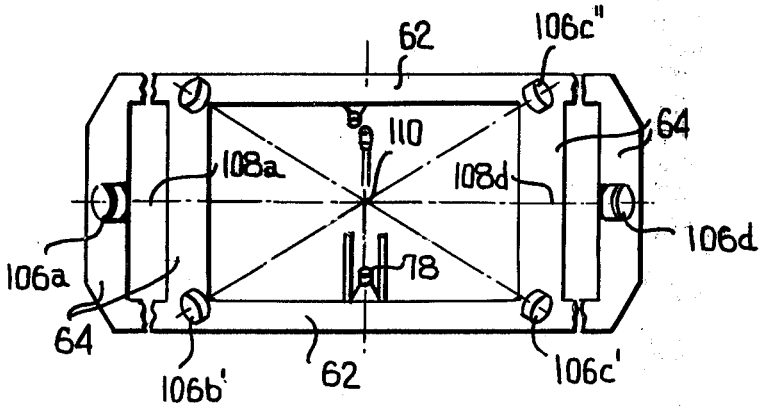
Figure 9:
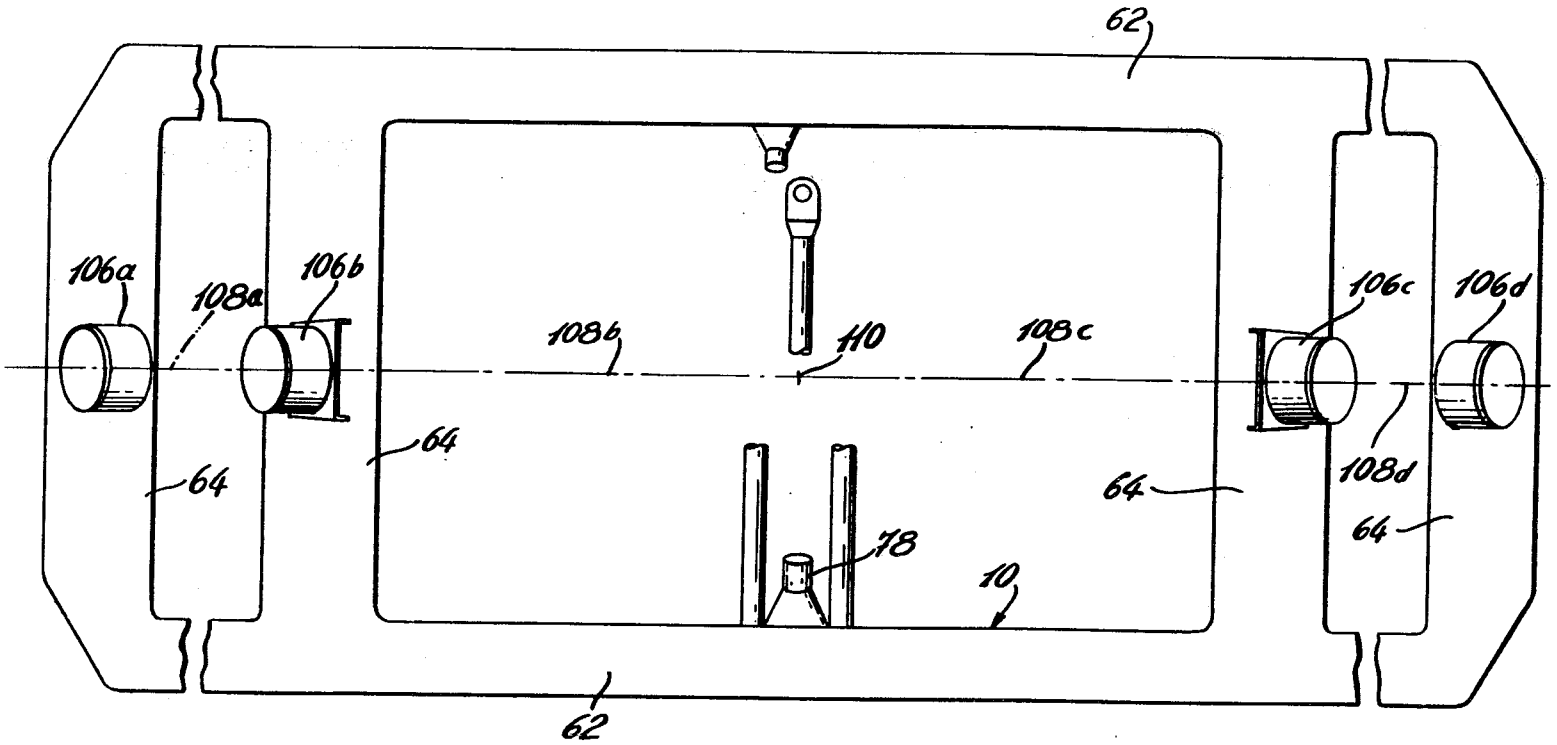
FIG. 9 is a top plan view of a span bolster structure for interconnecting two 3-axle trucks.

In FIGS. 9 and 10, a span bolster structure 10 is illustrated which would be used in association with two 3-axle trucks. In this arrangement, the span bolster 10 includes four lateral members 64, each lateral member being positioned substantially in alignment with one of the planes 92 of the 3-axle truck illustrated schematically in FIG. 7. Various arrangements of the primary pads can be utilized in association with such an arrangement. In particular, four primary pads 106*a*, 106*c* and 106*d* can be utilized by themselves, each primary pad being located in the central longitudinal centre plane of the span bolster structure. The compression axes 108*a* to 108*d* of these primary pads intersect at a point 110. Any or all of the primary pads 106*a* to 106*d* may be replaced by or used in combination with the primary pads as shown in FIGS. 9*a* and 9*b*. As a result, various combinations and arrangements of the primary pads mounted on the upper surface of the span bolster structure 10 can be utilized. The primary pads on each end of the span bolster structure 10 define triangular patterns, for example, pad 106*b* would comprise the apex of the pattern and pads 106*a'* and 106*a''* would define the base of the pattern. The patterns can be arranged so that the apexes of the patterns on opposite ends of the structure 10 face toward each other, as shown in FIG. 9*a*, or away from each other as shown in FIG. 9*b*, or in the same direction. In one example of the apexes facing in the same direction, the triangular patterns would be defined by the following primary pads: 106*a*; 106*b'*; 106*b''*; 106*c*; 106*d'*; and 106*d''*.

Figure 11:
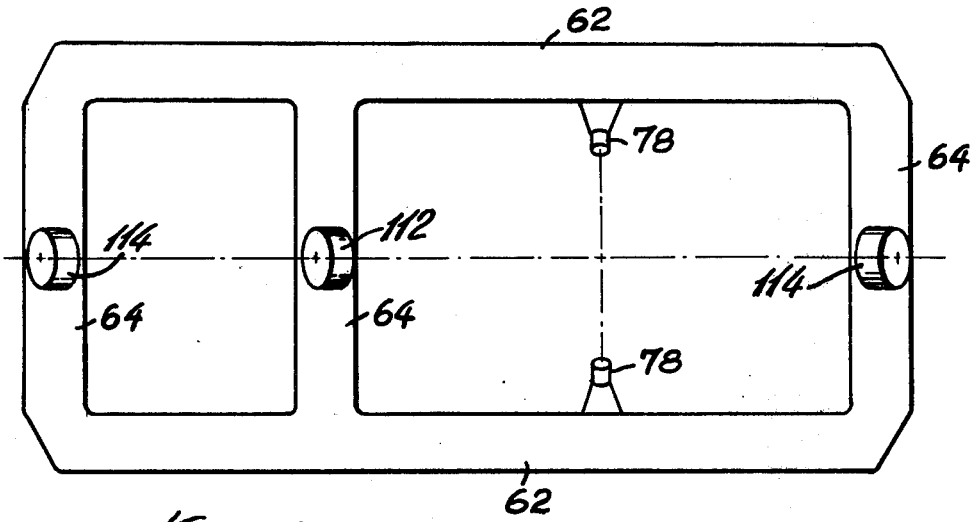
FIG. 11 is a top plan view of a span bolster structure for interconnecting a 2-axle truck and a 3-axle truck.

FIG. 11 illustrates a span bolster arrangement utilized when a 3-axle truck is combined with a 2-axle truck, wherein an arrangement at the end of the span bolster 10 above the 3-axle truck is identical to that used at one end of the span bolster 10 in FIG. 9, whereas the other end of the span bolster structure above the 2-axle truck is similar to that illustrated in either FIGS. 4 or 8. In FIG. 11, the primary pads are indicated by reference numeral 112, with alternative positions of the primary pads being illustrated in FIGS. 11*a*, 11*b*, 11*c* and 11*d* and indicated by reference numeral 114.

FIG. 12 illustrates one embodiment of the arrangement for mounting the primary pads, the primary pad in this Figure being indicated generally by reference numeral 116. The primary pad 116 comprises a laminate of rigid plates 118 interposed by resilient pads 120. Opposite ends of the primary pad 116 are secured by means of nuts and studs 122 to rigid parallel plates 124 and 126. Plate 124 is rigidly mounted on a base plate 128 at an angle to the plate such as to be parallel to the end surface of the primary pad 106. The plate 128 is secured by means of bolts 130 to the lower surface of a chassis 132. The plate 126 is rigidly mounted on its base plate 134 and likewise extends at an angle thereto identical to that of plate 128. The plate 134 is secured to the upper surface of the span bolster structure 10 by means of bolts 136. Each of the base plates 128 and 134 is provided with respective reinforcing webs 140 and 142, the reinforcing webs adding support strength to the respective angled plates 124 and 126. Alternative constructions can be utilized for mounting the primary resilient pads between the chassis and the span bolster structure without departing from the essence of the present invention.

I claim:

1. A span bolster arrangement for interconnecting a pair of railway trucks and mounting a railway vehicle chassis, the span bolster arrangement including a span bolster structure having side members interconnected by lateral members, the span bolster structure being mounted on and connected to a pair of railway trucks located beneath opposite ends of the span bolster structure, said railway trucks each having at least two axles having wheels with said wheels including under surfaces defining a plane of support, a plurality of elastic chassis support pads mounted on the span bolster structure, the plurality of elastic chassis support pads comprising primary load bearing pads and secondary stabilizing pads, said primary and secondary pads having first ends connected to said span bolster structure and second ends for connection to a lower surface of one end of a vehicle chassis to support that one end of the vehicle chassis in position above said span bolster structure; the primary load bearing pads being positioned and oriented on the span bolster structure and having compression axes extending downwardly and inwardly with all said compression axes intersecting at a virtual point on a longitudinal central plane of said span bolster structure approximately midway between said pair of trucks and at a height substantially corresponding to that of said support plane; said primary pads being in positions longitudinally of said span bolster structure wherein vertical components of compression forces receivable thereon are substantially in transverse planes defined by locations where the span bolster structure is connected to the railway truck with bending movements in said side members due to said vertical components being minimal; said secondary stabilizing pads including two pads transversely positioned on the side members of the span bolster structure and oriented so that the compression axes of said secondary pads extend upwardly and inwardly and intersect at a point in the longitudinal central plane and substantially directly above said point of intersection of the compression axes of said primary pads and at a height to stabilize an associated vehicle chassis related to said span bolster structure under normal operating conditions.

2. A span bolster arrangement as defined in claim 1 wherein each truck has only two axles, said lateral members being lateral end members, at least one of said primary load bearing pads being mounted on each of said lateral end members, and each lateral end member being connected to a respective two-axle truck.

3. A span bolster arrangement as defined in claim 2 wherein said one primary resilient pad mounted on each lateral end member is located in the central longitudinal plane of said span bolster structure.

4. A span bolster arrangement according to claim 2, wherein two of said primary resilient pads are mounted on each lateral end member and at opposite ends thereof.

5. A span bolster arrangement according to claim 2 wherein two of said primary load bearing pads are mounted at opposite ends of one of the lateral end members, and one primary load bearing pad is mounted at the center of the other lateral end member, said one primary load bearing pad being located in the central longitudinal plane of said span bolster structure.

6. A span bolster arrangement as defined in claim 1 wherein each of said trucks is a three-axle truck and said span bolster structure has two of said side members interconnected by four of said lateral members, two of said lateral members being situated adjacent each end of the span bolster structure; at least one of said primary load bearing pads being mounted on each of said lateral members.

7. A span bolster arrangement as defined in claim 6 wherein one of said primary load bearing pads is mounted on each of said lateral members with each primary load bearing pad being situated in the central longitudinal plane of said span bolster structure.

8. A span bolster arrangement as defined in claim 6 wherein said primary load bearing pads mounted on said lateral members adjacent each end of said span bolster structure are arranged in a triangular pattern having an apex lying in the central longitudinal plane of said span bolster structure and in a transverse plane of a respective one of said three-axle trucks, said triangular pattern having a base defined by two of said primary load bearing pads with said two primary load bearing pads being symmetrically positioned and laterally spaced-apart substantially in the respective transverse plane.

9. A span bolster arrangement as defined in claim 8, wherein the triangular patterns defined by the primary load bearing pads on the span bolster structure are positioned with the apexes toward one end of the span bolster structure.

10. A span bolster arrangement as defined in the claim 8, wherein the apexes of the two triangular patterns are adjacent.

11. A span bolster arrangement as defined in claim 8, wherein the triangular patterns are situated with their bases adjacent.

12. A span bolster arrangement as defined in claim 1 wherein said trucks include one two-axle truck and one three-axle truck, said span bolster structure having one of said lateral members positioned above said two-axle truck and two of said lateral members positioned above said three-axle truck, each of said lateral members having at least one of said primary load bearing pads mounted thereon.

13. A span bolster arrangement as defined in claim 12 wherein one of said primary load bearing pads mounted on each of said lateral members is situated in the central longitudinal plane of said span bolster structure.

14. A span bolster arrangement as defined in claim 12 wherein three of said primary load bearing pads are positioned in a triangular pattern above said three-axle truck on said two lateral members situated thereabove, said triangular pattern having an apex lying on the central longitudinal plane of said span bolster structure and a base having opposite corners thereof situated adjacent opposite ends of a respective one of said lateral members, the apex and the base of said triangular pattern being situated in respective transverse planes.

15. A span bolster arrangement as claimed in claim 14 wherein the apex of said triangular pattern is situated on an inner one of said two lateral members.

16. A span bolster arrangement as claimed in claim 14 wherein the base of said triangular pattern is situated on an outer one of said lateral members.

* * * * *